United States Patent [19]

Welsch et al.

[11] 3,961,672

[45] June 8, 1976

[54] IMPACT HAMMER POST DRIVER

[75] Inventors: John H. Welsch, Dunmore; Edward J. Sparrow, Blakely, both of Pa.

[73] Assignee: Sterling Engineering and Manufacturing Company, Wilkes-Barre, Pa.

[22] Filed: Nov. 13, 1974

[21] Appl. No.: 523,260

[52] U.S. Cl. ..... 173/43; 173/119; 173/131; 173/133; 254/29 R

[51] Int. Cl.[2] ..... E04H 17/26

[58] Field of Search ..... 173/28, 43, 46, 49, 173/131, 133, 126, 127; 254/29 R

[56] References Cited

UNITED STATES PATENTS

| | | | |
|---|---|---|---|
| 2,659,583 | 11/1953 | Dorkins | 173/43 X |
| 2,703,479 | 3/1955 | Richardson | 173/133 X |
| 2,940,267 | 6/1960 | Shaver | 173/43 X |
| 3,026,949 | 5/1962 | Eldridge et al. | 173/43 X |
| 3,302,731 | 2/1967 | Perry | 173/43 X |
| 3,355,146 | 11/1967 | Ashworth | 254/29 R |
| 3,394,766 | 7/1968 | Lebelle | 173/49 |
| 3,400,771 | 9/1968 | Dorn | 173/43 |
| 3,605,912 | 9/1971 | Fisher | 173/43 X |
| 3,703,934 | 11/1972 | Cartner | 173/43 |
| 3,783,953 | 1/1974 | Kopaska | 173/126 X |

*Primary Examiner*—Ernest R. Purser
*Assistant Examiner*—William F. Pate, III
*Attorney, Agent, or Firm*—Watson Leavenworth Kelton & Taggart

[57] ABSTRACT

The post driver apparatus of the instant invention is designed to be mounted on a truck chassis that can be readily moved from site to site and comprises a fluid-pressure impact hammer mounted in a shock absorbing cage assembly that permits rapid driving of posts into the ground without transmission of substantial shock forces to the frame and chassis on which the post driver is mounted. The apparatus is also equipped with means to vary the location and orientation of the impact hammer with respect to the truck chassis thereby minimizing the precision with which the truck chassis must be located.

17 Claims, 7 Drawing Figures

IMPACT HAMMER POST DRIVER

BACKGROUND OF THE INVENTION

Devices for driving posts into the ground are well known. Traditionally, most of those devices have been of the type wherein a relatively large dead mass is raised a substantial distance above the post to be driven and then released. Under the influence of gravity the mass falls until it hits the uppermost end of the post, driving the opposite end into the ground.

Generally, post drivers must be suitable for mounting on moveable platforms, such as a truck chassis, in order to permit movement of the post driver from one location to the next. Because of the necessity for making the device mobile, the traditional gravity devices described above have certain disadvantages. The mass of the dead weight which does the driving must be fairly large to accomplish the purpose; yet, the larger it becomes the more difficultly there is in making it mobile. Moreover, because the energy imparted to the post by the weight is directly proportional to the height that the weight is raised above the post prior to release, a balance must be struck between the height of the boom most desirable for use in driving posts and the height most suitable for maintaining mobility of the device.

Additionally, the process of raising a weight and permitting it to fall onto a post is a rather slow and tedious procedure. With labor costs increasing rapidly, the time required to drive posts by the traditional method represents a substantial shortcoming.

Thus, it is desirable to have a post driver device which does not require an excessively long boom, does not require a very large moveable dead mass and drives posts quite rapidly.

SUMMARY OF THE INVENTION

The present invention is concerned with a post driving device which employs a fluid actuated impact hammer. Such a hammer is not dropped on the post, but instead, during the driving operation is maintained in contact with the uppermost end of the post. The present invention, therefore, eliminates the need for the high boom that is characteristic of gravity operated mechanisms. In addition, unlike the gravity devices, the energy transmitted to the post in the device of this invention is a function of the fluid pressure created within the hammer and thus is not directly related to the mass of the driving element. Finally, because the driving forces are the result of fluid impulses and because fluid impulses can be generated in rapid succession, the time normally associated with driving a post by the more traditional means is reduced by as much as two thirds.

It has been found, however, that simply substituting a well known impact hammer for the dead weight on existing post driving booms does not produce a satisfactory device. The substantial reaction forces known to be developed by such hammers have been found to cause rapid destruction of the booms and of the truck chassis upon which the devices are mounted. The instant invention therefore incorporates a recoil mechanism which acts to prevent transmission of most of the reaction force shocks to the main body of the post driving mechanism and truck.

Recoil mechanisms are particularly important in post driving devices capable of driving relatively large diameter posts requiring relatively large driving forces. In smaller devices designed to drive small diameter posts, such as ground rods, the driving forces developed are not as great and the reaction forces are also relatively small. The need for shock absorbing mechanisms is therefore substantially lessened. Thus, for example, the device described in U.S. Pat. No. 3,732,935 which appears to employ an impact hammer does not incorporate any recoil mechanism.

The device described herein comprises a driving head assembly containing a fluid driven impact hammer, which hammer, when connected to suitable high pressure fluid lines, is capable of creating intermittent fluid pressure impulses. The entire driving head assembly is carried on a tower and the tower is attached to a truck chassis in such a fashion as to permit its rotation about a horizontal axis from a "transport" position to an "operating" position. Means are also provided for rotating the tower, in its "operating" position, about a vertical axis and for moving the tower laterally with respect to the truck chassis. The tower itself is also rotatable about one of its own vertical axes. Rotation of the tower about the two vertical axes and the means provided for lateral movement enable the operator to locate and orient the driving head above the post, after the truck chassis is brought to the approximate position, without further movement of the truck.

When the tower is in the vertical position the driving head can be lowered vertically along guides by means of a hydraulic cylinder. After the driving head is lowered onto the post, the same hydraulic cylinder acts to exert static pressure on the post.

The driving head assembly also contains a cage within which the impact hammer is located. Between the impact hammer and the cage, compression springs are provided to absorb reaction forces within the driving head assembly. The compression springs serve to insulate the tower and truck from most of the forces generated by the hammer.

At its lower end the impact hammer carries a shank through which the driving force is transmitted. The shank bears upon an anvil which has an elongated reduced diameter body attached to a larger diameter collar. The elongated body passes through an aperture in the lower end of the cage but the collar diameter is sufficiently large to prevent passage of the entire anvil through the cage. In the relaxed state, the anvil collar seats on the lower plate of the cage.

The lower end of the anvil loosely carries an adapter plate. The adapter plate has a recess in it for receiving and retaining the uppermost portion of the post. Means are also provided for aligning the post, when seated in the adapter plate, with the hammer.

When operated, the apparatus is brought to the location where a post is to be driven into the ground. The tower is raised to a vertical or driving position and the driving head is located above and approximately aligned with the post. The cage carrying the hammer is then lowered by the hydraulic cylinder until the adapter plate receives the uppermost end of the post in its recess and is seated against the lower end of the anvil. The hydraulic cylinder then continues to exert additional pressure on the cage, thereby lowering the cage bottom away from the anvil collar, which cannot move down further because of the post. This lowering of the cage away from the collar forces the springs into compression. Pressure is further increased on the cage until an equilibrium is reached with the spring forces.

At that point, fluid pressure is applied to the hammer and pressure impulses are begun. Each impulse causes additional downward force to be transmitted from the hammer to the post. In addition, each pressure impulse also generates a reaction force which acts upwardly on the hammer. The energy from that reaction force causes further compression of the springs. Thereafter, during a pressure trough between impulses the reaction force energy stored in the springs is redelivered to the post through the impact hammer, shaft, anvil and adapter plate. The springs thereby prevent transmission of most of the reaction force from the impact hammer to the remainder of the post driving apparatus and the truck chassis. Additional damping is also provided by the hydraulic cylinder.

The invention accordingly comprises the features of construction, combination of elements and arrangement of parts which will be exemplified in the apparatus hereinafter described and the scope of the invention will be indicated in the claims.

BRIEF DESCRIPTION OF THE DRAWINGS

For a thorough understanding of the nature and features of the invention, reference should be had to the following detailed description taken in connection with the accompanying drawings in which.

In the drawings, like reference numerals have been employed to refer to like parts throughout.

DETAILED DESCRIPTION OF PREFERRED EMBODIMENTS

Figure 1:
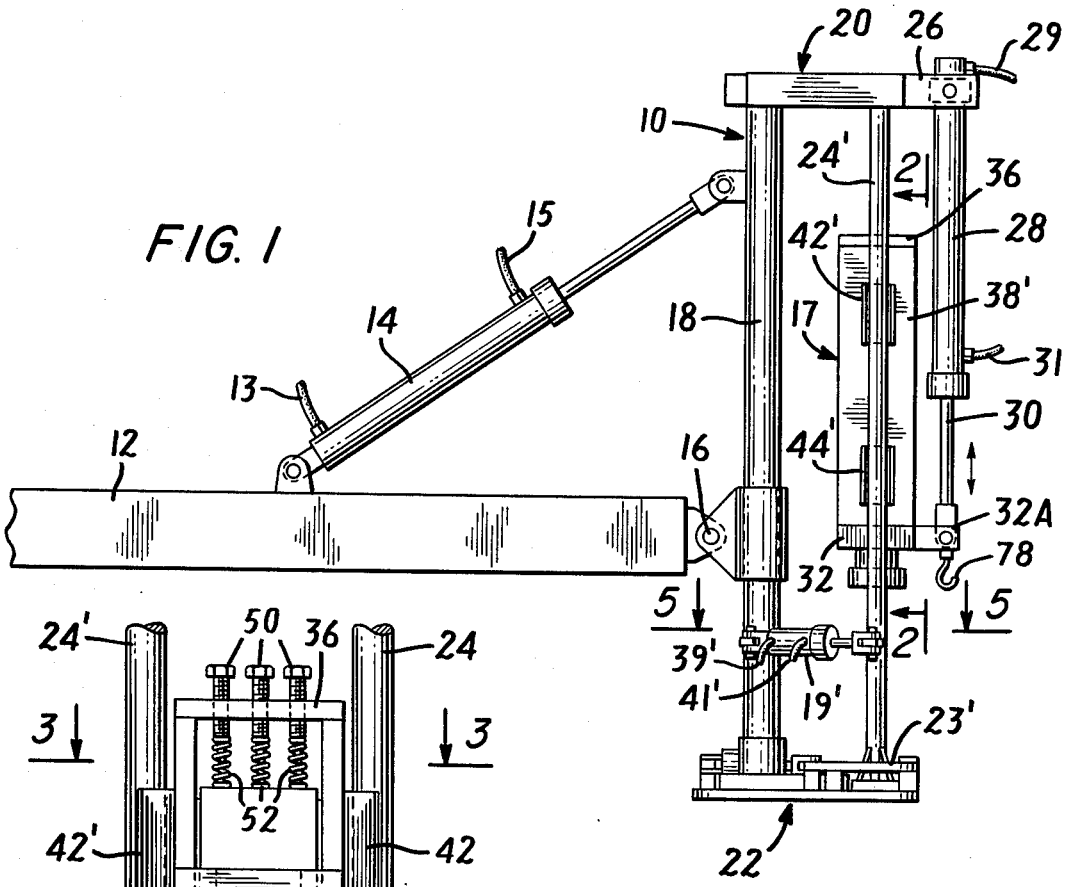
FIG. 1 is a side view of a post driver incorporating the instant invention, seen in the vertical or "operating" position.

As shown in FIG. 1, a tower, denoted generally by the reference numeral 10, is carried by horizontal frame 12. Frame 12 is carried on the back of a truck chassis (not shown) and in accordance with conventional practice well known to those skilled in the art, frame 12 can be moved linearly with respect to the truck chassis and can be pivoted about an axis on the chassis. Hydraulic cylinder 14 is attached at one end to frame 12 and at the other end to tower 10 and operates to rotate the post driver apparatus around pivot 16 between the substantially horizontal or "transport" position and the vertical or "operating" position. The application of fluid pressure through line 13 raises the tower from the transport to the operating position and the application of fluid pressure through line 15 lowers the tower back to the transport position. Apparatus comprising a fluid pump, valves and attendant fittings (not shown) for generating and applying fluid pressure to cylinder 14 through lines 13 and 15 is also provided. Such devices are conventional, readily available and are well known to those skilled in the art.

Figure 2:
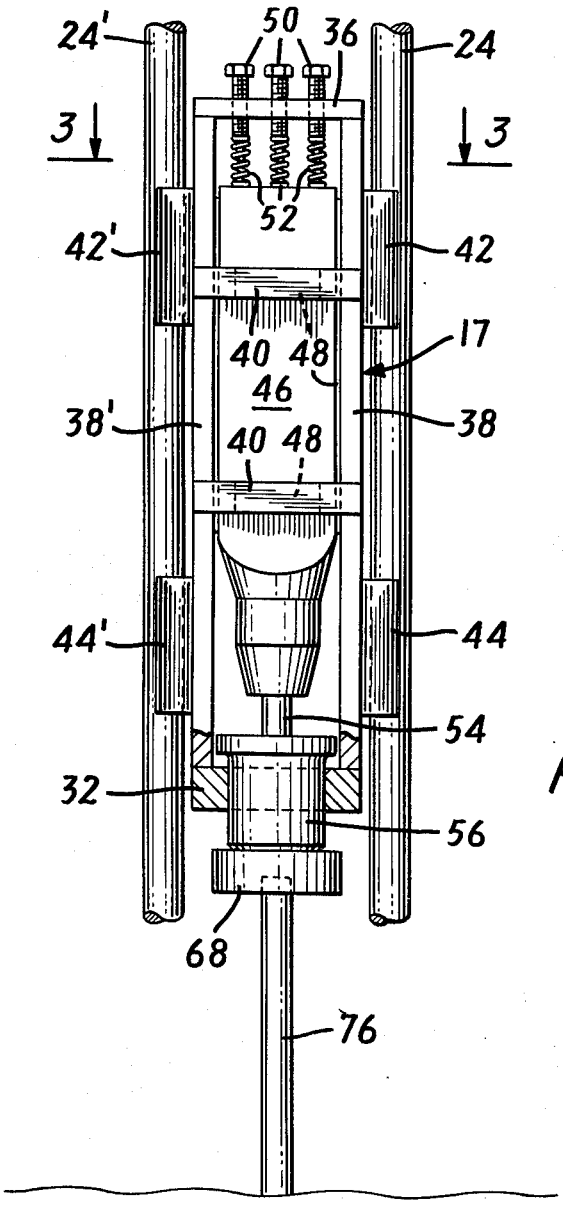
FIG. 2 is a front view of the cage and impact hammer assembly taken along line 2—2 of FIG. 1.
Figure 3:
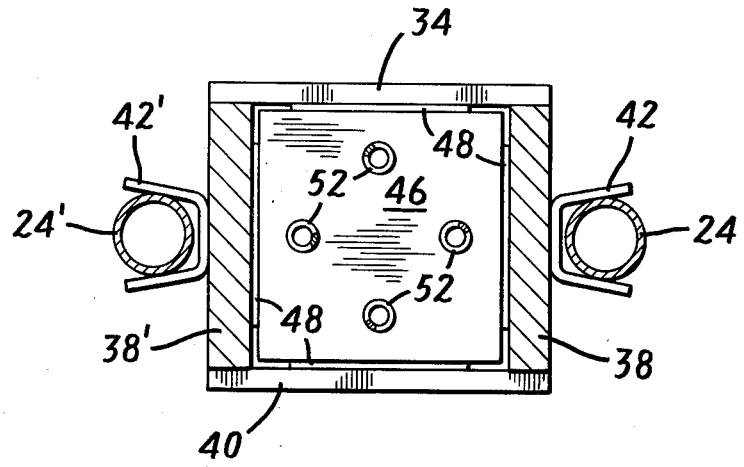
FIG. 3 is a top view taken along lines 3—3 of FIG. 2.
Figure 5:
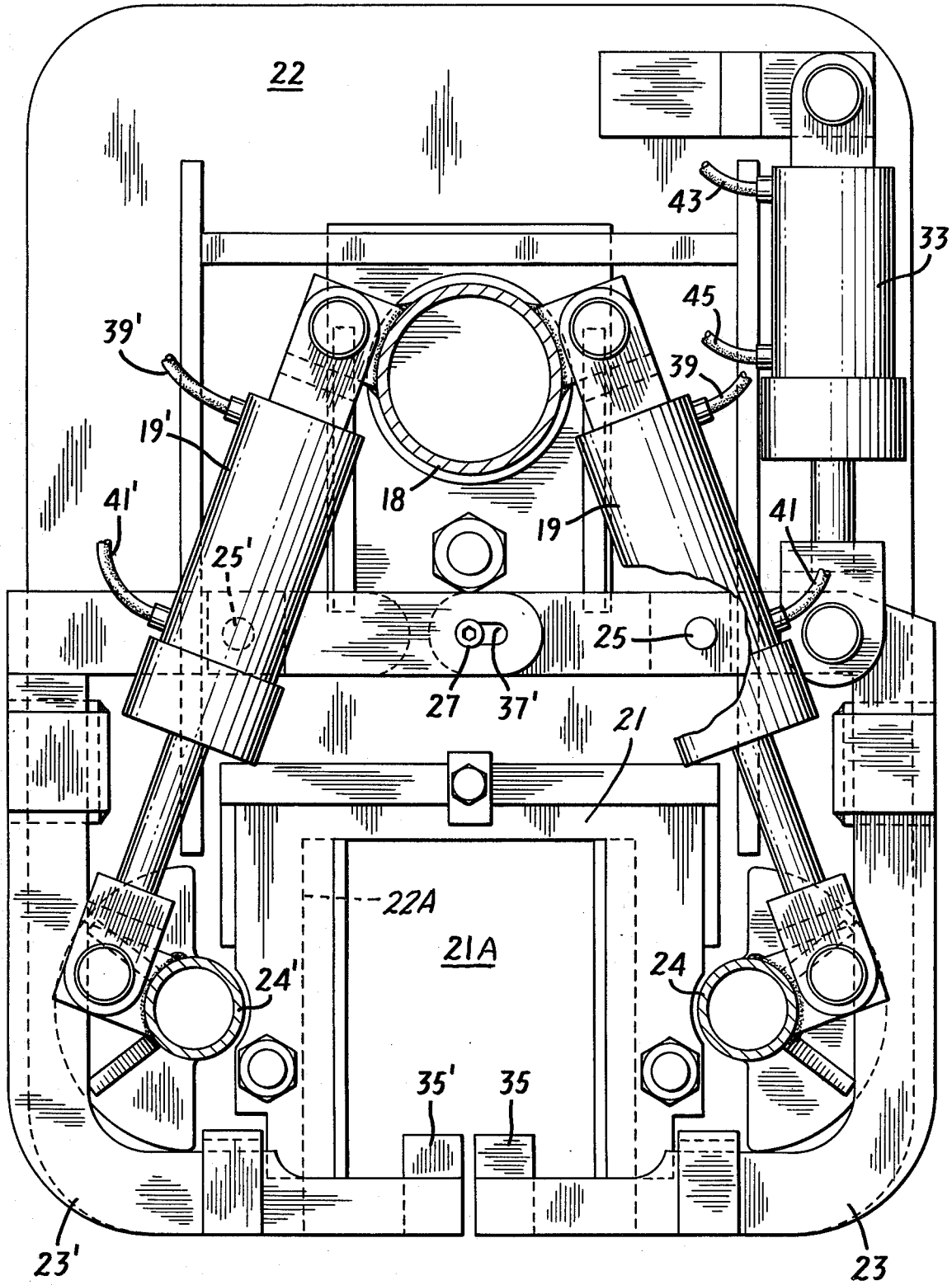
FIG. 5 is a top view taken along line 5—5 of FIG. 1 showing the base foot, gate mechanism and angling cylinders.

The tower itself is comprised of support column 18, top member 20, base foot 22, two guide rails 24 and 24' (as best seen in FIG. 2) and angling cylinders 19 and 19' (as best seen in FIG. 5).

Attached to the front of top member 20 is an extension beam 26 which carries the upper end of pressure cylinder 28. Pressure cylinder piston rod 30 is moveable longitudinally with respect to cylinder 28 in response to the application of fluid pressure. Fluid pressure through line 29 lowers the rod, and fluid pressure through line 31 raises the rod within cylinder 28. In the transport position, rod 30 is fully retracted within cylinder 28. A pump, valves, fluid lines and fittings are provided for cylinder 28 but are not shown.

Top member 20 and base foot 22 are attached to column 18 in such fashion as to permit their rotation about the axis of column 18. Guide rails 24 and 24' are secured to top member 20 and base foot 22 so that rotation of the rails also produces rotation of these latter two elements. Angling cylinders 19 and 19' are provided to accomplish such rotation by means of application of fluid pressure through lines 39, 41, 39' and 41'. A fluid pump, valves and attendant fittings (not shown) are also provided for actuating cylinders 19 and 19'.

Base foot 22 is provided with an opening 22A for receiving the post to be driven. A gate mechanism comprising arms 23 and 23', pivot pins 25 and 25' and connecting pin 27 is activated by gate cylinder 33. Gate arm 23 is equipped with a hole that carries pin 27 in it and arm 23' is provided with a slot 37' in which the projecting portion of pin 27 rides. Each gate arm can be equipped with a removable block 35 and 35' at one end and an adapter 21 having recess 21A is secured to base foot 22 and is made to be interchangeable with similar adapters having recesses 21A of different sizes and configurations. Blocks 35, 35' and the interchangeable adapters make the apparatus useable with posts of different sizes and shapes. Once again, a fluid pump, valves and attendant fittings (not shown) are provided for application of fluid pressure to lines 43 and 45. Pressure in line 43 closes the gate arms and pressure in line 45 opens them.

Returning to the driving apparatus, the lower end of rod 30 is attached to extension arm 32A of driving head assembly 17. As is best seen in FIG. 2, one of the elements comprising driving head assembly 17 is a cage having a top plate 36, bottom plate 32, side plates 38 and 38', front cross ribs 40 and rear cross ribs 34. Extension 32A is attached to bottom plate 32. Two upper channel members, 42 and 42' and two lower channel members 44 and 44' are mounted on the outsides of side plates 38 and 38' and fit around guide rails 24 and 24' so that the driving head assembly 17 can move vertically along rails 24 and 24' without being permitted any substantial degree of horizontal freedom relative to tower 10.

Retained within the cage and comprising another element of head assembly 17 is impact hammer 46. Any number of commercially available impact hammers can be employed. One such hammer that applicants have found to be suitable is Ingersoll Rand Impact Hammer No. G-500. Although the operating fluid preferred for operating hammer 46 is oil, any fluid can be employed. Similarly, oil is the preferred (although not required) fluid for cylinders 14, 19, 19' 28 and 33. Suitable fluid lines, valves and fittings (not shown) are provided to connect the operating fluid within hammer 46 to a fluid pump (also not shown) in conventional fashion. The impact hammer contains apparatus for generating fluid pressure pulses upon being connected to a high pressure fluid line.

Impact hammer 46 is not fixedly secured to the cage but is retained within it by virtue of the construction thereof. Because relative movement is permitted between the impact hammer and the cage, bronze wear plates 48 are placed between hammer and the elements of the cage.

Top plate 36 of the cage is provided with four threaded holes suitable for receiving threaded bolts 50. Each bolt 50 has a reduced diameter end portion designed to fit into one end of a compression spring 52. The opposite end of each spring 52 engages the top face of hammer 46.

The lower end of hammer 46 is fitted with a shank 54 which passes into hammer 46 and is moveable longitudinally with respect to the hammer in response to the pressure pulses. Shank 54 is so constructed and positioned that when a pressure pulse is transmitted to the working fluid within hammer 46 it tends to force shank 54 out of the hammer.

Figure 4:
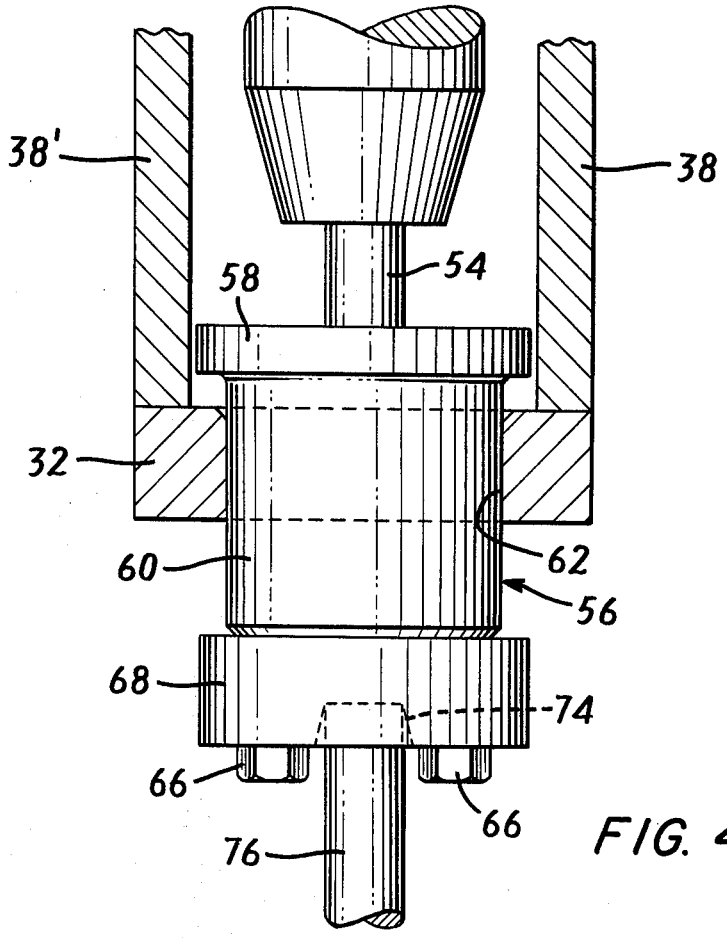
FIG. 4 is a detailed view of the shaft, anvil and adapter plate.

As is best seen in FIG. 4, the lower end of shank 54 abuts the upper face of anvil 56. Anvil 56 is comprised of a large diameter collar 58 and a reduced diameter body 60. Bottom plate 32 of the cage is provided with an apperture 62 adapted to receive body 60 of anvil 56 and permit relatively free vertical movement therein but is of such diameter as to prevent passage of collar 58 therethrough.

Figure 6:
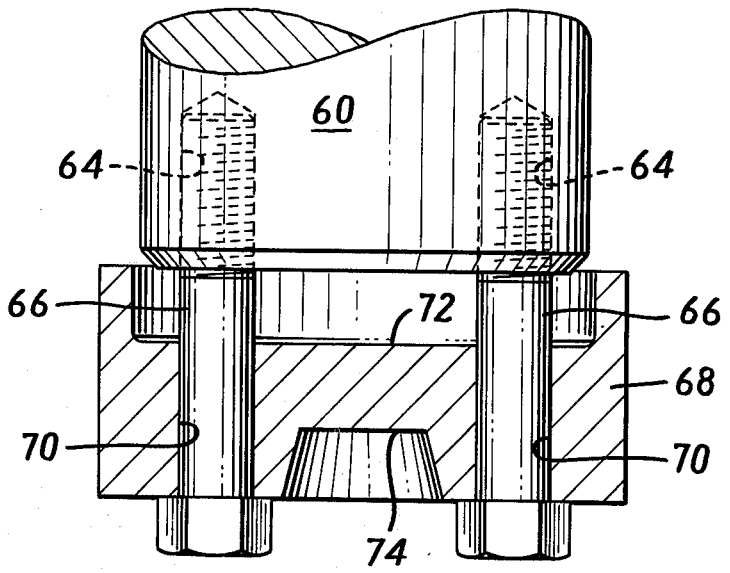
FIG. 6 is a detailed view of one embodiment of the adapter plate and its attachment to the anvil.
Figure 7:
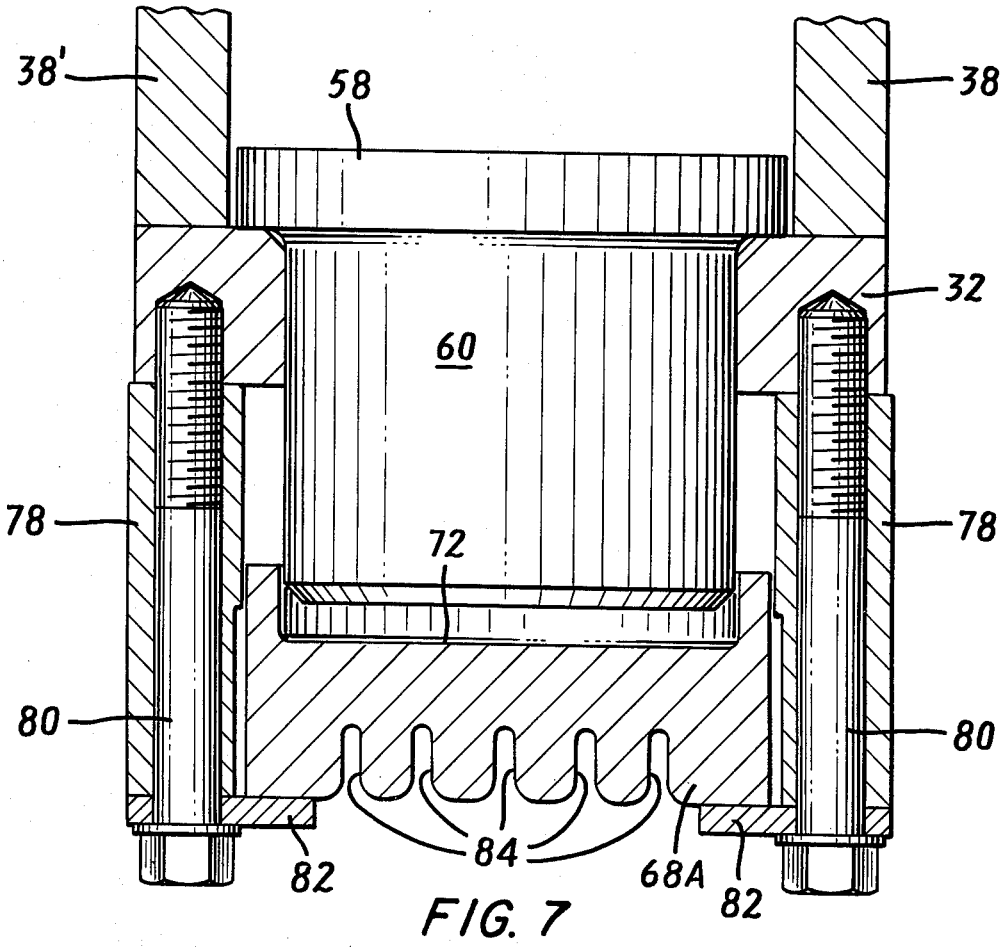
FIG. 7 is a detailed view of a second embodiment of the adapter plate and its attachment to the anvil.

In order to facilitate use of the post driver to drive posts of differing configurations and sizes, anvil 56 carries an adapter plate 68. One embodiment of a suitable adapter plate is shown in FIG. 6 and an alternative embodiment is shown in FIG. 7. In the embodiment of FIG. 6, body 60 of anvil 56 is provided with threaded holes 64 for reception of bolts 66 and adapter plate 68 is provided with holes 70, which can be aligned with holes 64 and through which bolts 66 pass.

A recess 72 is provided in the top of adapter plate 68 for reception of anvil body 60 and another recess 74 is provided in the bottom face of plate 68 for reception of post 76. When bolts 66 are fully threaded into holes 64, adapter plate 68 is not tight against anvil 60. Instead, a limited amount of freedom is provided for to assist in seating post 76 in recess 74 and to aid in aligning post 76 with anvil 60.

In the FIG. 7 embodiment, two retainer bars 78 and two retainer plates 82 are secured by bolts 80 to bottom plate 32. The adapter plate 68A of FIG. 7 is provided with an upper recess 72 similar to recess 72 of FIG. 6., for reception of anvil body 60. Retainer plates 82 protrude inwardly from retainer bars 78 so that adapter 68A is retained by them within the space between bars 78 and anvil body 60. Within those confines, however, adapter 68A is permitted a limited amount of freedom to facilitate seating and aligning post 76. The bottom face of adapter 68A of FIG. 7 is provided with slots 84 for use in driving H and C shaped posts. The configuration of the bottom face of the adapter plate is independent of the means used to assure that the adapter plate has some freedom with respect to anvil 60.

In operation, the truck chassis is moved to the approximate site. The apparatus, in its "transport" position and with the base gate open, is raised to the "operating" or vertical position by activating cylinder 14. Positioning of driving head 17 over the post is accomplished by rotational and lateral movement of the conventional frame adjustment mechanism (not shown) on which frame 12 is mounted.

Sometimes the truck upon which the post driver is mounted is not stopped in precisely the proper place. When that occurs, movement of the frame adjustment mechanism to locate the adapter recess 21A over the precise spot into which the post is to be driven fails to orient properly the base foot 22 and plate 68. Such orientation is particularly important when the post to be driven is other than round, such as when driving H posts for use in connection with roadside guard rail fences. In that case it is necessary that the post be driven with the flanges of the H parallel to the road. To compensate for slight mislocation of the truck chassis, angling cylinders 19 and 19' are employed to turn the base foot 22 about the axis of column 18 so that its front edge is parallel to the edge of the road even though frame 12 may not be perpendicular to the road edge. In this way the criticality of the truck position is substantially reduced.

Once post 76 is properly located within opening 21A, fluid pressure is applied to line 43 of cylinder 33 to close gate arms 23 and 23' and retain post 76 within opening 21A during the driving operation. It will be seen that due to the design of the linkages, the movement of gate arms 23 and 23' is not across the open end of recess 21A. Instead, when blocks 35 and 35' are in close proximity to the post, their movement is essentially perpendicular to opening 21A. Because of this feature, even if post 76 is not fully seated within opening 21A, gate arms 23 and 23' can be closed and such closing acts to push the post into its properly seated position within opening 21A.

After the post is seated in opening 21A and the gate is closed, fluid pressure is applied to hydraulic line 29 of cylinder 28, thereby pushing rod 30 and driving head 17 downwardly towards the upper end of post 76. As head 17 is slowly being lowered onto the post, the operator manually positions the post so that it seats in plate 68. As plate 68 engages post 76 and is lowered further, recess 72 of the plate is urged over anvil body 60 until the plate is secure against the bottom face of the anvil body. Since further downward movement of post 76, plate 68, anvil 56 and shank 54 is prevented by the post's engagement with the ground, increased pressure in cylinder 28 which is transmitted through rod 30 to the cage, lowers plate 32 without any substantial additional downward movement of the anvil. This downward movement of the cage assembly relative to the anvil, shank and hammer assembly disengages anvil collar 58 from the upper face of plate 32 and compresses springs 52. Compression of the springs increases until such time as the force exerted by the springs is equal to that which is exerted by rod 30.

At that point, the apparatus is ready to begin driving the post into the ground. Fluid pressure is applied to hammer 46 which activates the impulse generator within. Fluid pressure pulses, as many as 890 per minute, are delivered to the upper end of shank 54, thereby urging it downward. The downward force from each pulse is transmitted through anvil 56 and adapter plate 68 and acts to drive post 76 into the ground. The equal and opposite upward reaction force simultaneously produced by such pressure pulse is transmitted to the body of hammer 46. That upward reaction force further compresses springs 52. When the pressure pulse in the fluid medium within hammer 46 subsides, the reaction force energy stored in springs 52 is redelivered through hammer 46, to shank 54, anvil 56, adapter plate 68 and finally to post 76.

It has been found that when using a post driver of the type described above, only a minor amount of the reaction force is transmitted to tower 10 and frame 12. The driving head is substantially isolated from the main body of the tower and most of the forces created by the pressure pulses act to drive the post and are not dissipated in wrecking the remainder of the apparatus. Additionally, vertical shocks cannot be transmitted from the post to the cage (and hence to the pressure cylinder) except through the springs, a feature which further serves to protect the pressure cylinder and the tower.

When post 76 is driven into the ground as far as is desired, fluid pressure is no longer applied to line 29 but instead is applied to line 31, thereby raising head 17 away from post 76. At about the same time the fluid pressure in line 43 is released and is applied to line 45 thereby opening gate arms 23 and 23' and permitting removal of base foot 22 from post 76. The design of the gate arm linkages permits easy opening of the arms with virtually no resistance due to friction between the arms and the post.

From the above description it can be seen that hammer 46 vibrates or oscilates rapidly within the cage. Since binding is a common phenomenon between ferrous metals of similar composition, bronze wear plates 48 are provided between the hammer and the cage. These wear plates minimize such binding and assure relatively free movement between hammer and cage.

The post driving apparatus of the instant invention can also be provided with means for removing posts from the ground. Thus, in FIG. 1 a hook, 78 is provided on extension arm 32A of driving head 17. In order to remove a post from the ground a clamp, rope, cable or some similar device is attached between the post and the hook. Fluid pressure is applied to line 31 of cylinder 28 so that an upward or retraction force is applied through rod 30, arm 32A and hook 78 to post 76. In the event sufficient retraction force cannot be created by the fluid pump connected to cylinder 28, pressure impulses can simultaneously be delivered through hammer 46. Such pressure pulses, when combined with the cylinder 28 retraction force, produce a pulsating retraction force which tends to vibrate the post and loosen it from the earth.

As can be seen, the apparatus described herein contains six fluid-pressure elements, cylinders 14, 19 19', 28 and 33, and hammer 46. Although there is no requirement that all six of these elements employ the same fluid, it has been found convenient that they do so. A single fluid reservoir can then be provided upon which all six can draw. Also, a single fluid pump can then, through appropriate valve arrangements, supply all the fluid pressure requirements of the post driver apparatus.

It will thus be seen that the shortcomings of the prior art devices set forth above are overcome by the subject invention and that additional advantages, as will be apparent from the preceeding description, inhere in the subject invention. Since certain changes may be made in the apparatus described above without departing from the scope of the invention, it is intended that all matter contained in the above description or shown in the accompanying drawings shall be interpreted as illustrative and not in a limiting sense.

Having described our invention, what we claim as new and desire to secure by Letters Patent is the novel subject matter defined in the following claims:

1. A fluid impulse post-driving apparatus comprising a. a tower;

b. at least one fluid reservoir;

c. a fluid-pressure actuated impact hammer having a fluid chamber therein and operating fluid in said chamber;

d. means for positioning said hammer in line with a post to be driven;

e. a cage for retaining said hammer therein;

f. advancing means having a first and a second end, said first end secured to said tower and said second end secured to said cage wherein said advancing means is adapted to move said cage longitudinally toward and away from said post after said hammer has been positioned by said positioning means;

g. fluid pressure operated means for applying and maintaining static pressure on said post while it is being driven, said static pressure means being capable of applying static pressure to said post only through said hammer;

h. a shank, moveable with respect to said hammer, intervening said hammer and said post and positioned to transmit force from said fluid chamber within said hammer to said post;

i. fluid-pressure generating means communicating with said fluid chamber;

j. fluid-pressure impulse generating means for creating intermittent fluid pressure pulses in said operating fluid, said pressure pulses producing downward forces on said shank and upward reaction forces on said hammer;

k. resilient means positioned to receive and store energy from said reaction forces, said resilient means engaging said hammer for redelivery of said stored energy to said post through said hammer and said shank, during the period between pressure pulses; and l. anvil means alignable with and intervening said post and said shank and including means for maintaining alignment between said shank and said post, said anvil means being constructed and positioned to transmit said downward force from said shank to said post when said static pressure is being applied to said post, said construction and positioning of said anvil preventing transmission of upward forces from said post to said cage except through said resilient means.

2. The apparatus of claim 1 wherein said fluid pressure impulse generating means comprises part of said impact hammer.

3. The apparatus of claim 1 wherein said resilient means engagably intervenes said cage and said hammer.

4. The apparatus of claim 1 wherein said resilient means is comprised of at least one compression spring.

5. The apparatus of claim 1 wherein said tower is mounted on a mobile platform, there being means for selectively rotating said tower on said platform between a horizontal transport position and a vertical operating position.

6. The apparatus of claim 1 wherein said advancing means and said static pressure means are embodied in a single structure, said structure being a fluid-pressure cylinder and piston rod assembly, said cylinder being one of said ends and said piston rod being the other of said ends.

7. The apparatus of claim 5 wherein said rotation is produced by activation of a fluid-pressure tower cylinder-and-piston-rod assembly.

8. The apparatus of claim 1 wherein said anvil means comprises an adapter plate having recess means therein for aligning and retaining said posts.

9. The apparatus of claim 8 wherein said adapter plate is detachably connected with said anvil means for selective employment with said anvil means of adapter plates configured for use with posts of different sizes and shapes.

10. The apparatus of claim 1 wherein said anvil means further comprises an anvil body and an anvil collar above said anvil body, said body having a first diameter and said collar having a second diameter and wherein said second diameter is larger than said first diameter.

11. The apparatus of claim 10 wherein said cage has a bottom plate and an aperture therethrough, said aperture having a diameter intermediate between said second diameter and said first diameter, said anvil body passing through said bottom plate aperture, said anvil collar resting on said bottom plate when no pressure is applied to said post by said post-driving apparatus, application of static pressure by said static pressure means disengaging said bottom plate from said collar.

12. The apparatus of claim 11 wherein said resilient means is comprised of at least one compression spring, the disengagement of said bottom plate from said collar causing compression of said spring.

13. The apparatus of claim 1 wherein said tower includes:

a. a support column;
b. a base foot; and
c. at least two guide rails; said cage being retained between but being moveable longitudinally with respect to said guide rails.

14. The apparatus of claim 13 wherein said base foot includes;

a. an open ended recess adapted to receive said post;
b. gate means; and
c. fluid-pressure gate cylinder means; wherein said gate cylinder means is adapted to close said gate means in front of said open end of said recess after said post is received within said recess.

15. The apparatus of claim 14 wherein there is also provided fluid-pressure angling cylinder means, wherein said guide rails are fixedly secured to said base foot and wherein said base foot and said guide rails are rotatable about said support column in response to the application of fluid pressure to said angling cylider means.

16. The apparatus of claim 1 further comprising means carried at the second end of said advancing means and connectable with a post for extracting said post from the ground when said advancing means is operated to move same in a direction away from the post.

17. A fluid impulse post-driving apparatus comprising a. a tower;
b. at least one fluid reservoir;
c. a fluid-pressure actuated impact hammer having a fluid chamber therein and operating fluid in said chamber;
d. means for positioning said hammer in line with a post to be driven;
e. a cage for retaining said hammer therein;
f. advancing means having a first and a second end, said first end secured to said tower and said second end secured to said cage wherein said advancing means is adapted to move said cage longitudinally toward and away from said post after said hammer has been positioned by said positioning means;
g. static pressure means for applying and maintaining static pressure on said post while it it being driven, said static pressure means being capable of applying static pressure to said post only through said hammer;
h. a shank, moveable with respect to said hammer, intervening said hammer and said post and positioned to transmit force from said fluid chamber within said hammer to said post;
i. fluid-pressure generating means communicating with said fluid chamber;
j. fluid-pressure impulse generating means for creating intermittent fluid pressure pulses in said operating fluid, said pressure pulses producing downward forces on said shank and upward reaction forces on said hammer;
k. resilient means positioned to receive and store energy from said reaction forces, said resilient means engaging said hammer for redelivery of said stored energy to said post through said hammer and said shank during the period between pressure pulses; and
l. anvil means alignable with and intervening said post and said shank and including means for maintaining alignment between said shank and said post, said anvil means being constructed and positioned to transmit said downward force from said shank to said post when said static pressure is being applied to said post, said construction and positioning of said anvil preventing transmission of upward forces from said post to said cage except through said resilient means; said tower including a support column; a base foot; and at least two guide rails; said cage being retained between but being moveable longitudinally with respect to said guide rails; said base foot including an open ended recess adapted to receive said post, gate means; and fluid-pressure gate cylinder means; said gate cylinder means being adapted to close said gate means in front of said open end of said recess after said post is received within said recess, said base foot further having a detachable adapter having an open ended recess therein, said adapter being interchangeable with adapters having open ended recesses of differing sizes and configurations for use with posts of correspondingly different sizes and shapes.

* * * * *